US005282558A

United States Patent [19]

Martinez

[11] Patent Number: 5,282,558

[45] Date of Patent: Feb. 1, 1994

[54] ARM FREEING GUN SLING

[76] Inventor: Martin J. Martinez, 1628 West 700 South, Ogden, Utah 84404

[21] Appl. No.: 901,941

[22] Filed: Jun. 22, 1992

[51] Int. Cl.[5] ..... F41C 23/02

[52] U.S. Cl. ..... 224/150; 224/151; 224/258; 224/913

[58] Field of Search ..... 224/150, 151, 257, 258, 224/264, 259, 913

[56] References Cited

U.S. PATENT DOCUMENTS

| | | | |
|---|---|---|---|
| 1,323,701 | 12/1919 | Lethern | 224/150 |
| 2,915,233 | 12/1959 | Moomaw | 224/202 |
| 3,595,451 | 7/1971 | Branby | 224/150 |
| 3,655,106 | 4/1972 | Wojcinski | 224/150 |
| 3,948,323 | 4/1976 | Hathaway . | |
| 4,249,686 | 2/1981 | Morwood | 224/150 |
| 4,511,070 | 4/1985 | Hightower | 224/150 |
| 4,817,835 | 4/1989 | Tarr, Jr. | 224/150 |
| 5,082,155 | 1/1992 | Salvador | 224/150 |

*Primary Examiner*—Linda J. Sholl
*Attorney, Agent, or Firm*—A. Ray Osburn

[57] ABSTRACT

The sling for a rifle or shotgun, which allows the firearm to be retained suspended from the shoulder without sliding off while the associated arm and hand are otherwise engaged. An auxiliary strap assembly may be secured to form a stabilizing, neck-encircling loop, and stored out of the way flatly against the main sling when not in use.

3 Claims, 3 Drawing Sheets

FIG. 3
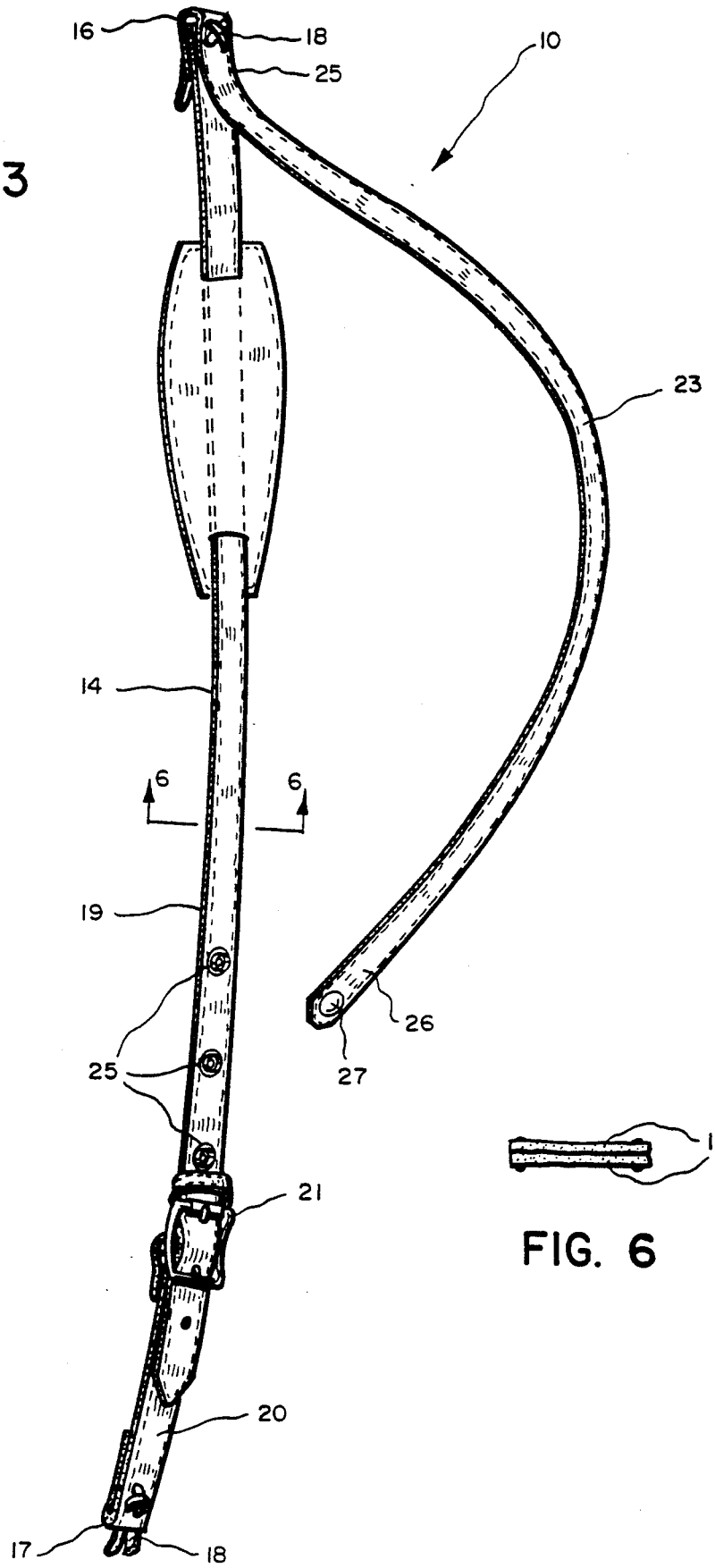
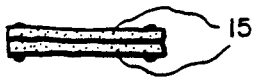
FIG. 6

ARM FREEING GUN SLING

BACKGROUND OF THE INVENTION

1. Field

The field of the invention is carrying slings for rifles and shotguns, and more particularly, such slings that free the arm and hand for other uses while the gun is being carried.

2. State of the Art

Basic prior art carrying slings comprise a flexible strap assembly secured respectively at its lower and upper ends to the firearm at the butt portion and the forearm portion. The lower connection is to the butt of the stock, while the upper is to the magazine, barrel or upper end of the stock. Sling attachment swivels or the like are typically provided on the rifle or shotgun. Many prior art slings include a pair of buckle connected segments for adjustment of the length to accommodate individual users. The strap assembly is placed forwardly over a shoulder, disposing the gun rearwardly, suspended angled down and forward along the side of the body. The sling strap tends to slide sideways off the shoulder, and must therefore be gripped by the associated hand to be retained.

When the gun bearer must otherwise use the sling-gripping hand, the sling slides off the shoulder, jeopardizing control of the firearm. The hunter, for example, cannot without great difficulty handle his gun while lifting or carrying a slain deer. The rifle may be dropped, accidentally discharged or damaged.

Few prior art sling designs directly address the problem of firearm retention without the use of the associated arm and hand. U.S. Pat. No. 3,441,185 discloses a sling with a sliding loop, carrying the gun diagonally across the chest with the sling diagonally across the back. This arrangement does not permit the gun to be carried upon the shoulder in the usual manner. It is complex and may tangle upon weapon removal from the body. U.S. Pat. No. 4,768,689 discloses a design for carrying a rifle, for example, diagonally across the chest or vertically along the center of the back. Its many straps and loops may cause tangling. The sling assembly of U.S. Pat. No. 3,098,591 utilizes two separate slings, with a body-encircling strap joining their mid-points. The gun is retained upon the shoulder, but the complex, tangling multiple straps are again present. U.S. Pat. No. 3,948,423 discloses an auxiliary sling of substantially greater length than the primary sling. Stretched elastically about the torso, it holds the firearm tightly against the body. Both hands are freed, but the body itself is considerably constrained against free movement. Although provided with a slip buckle for minor length adjustment, its extended length renders sufficient shortening for snug storage against the main sling impractical. Such storage is not disclosed or suggested.

A need therefore remains for a sling which may be used to retain a firearm upon the shoulder without use of the associated arm and hand, while not significantly encumbering the body of the user, and which may be stored on the sling to avoid entanglement when not in use.

BRIEF SUMMARY OF THE INVENTION

The foregoing shortcomings and disadvantages in prior art gun carrying slings are eliminated or substantially alleviated in the present invention, which comprises an elongate main strap assembly with its ends attached to the firearm to form a shoulder engaging loop. The main strap assembly may comprise two separate segments which may be attached adjustably, so that the size of the loop is selective to the rifle or shotgun carrier. The inventive sling further comprises an auxiliary strap assembly secured at its upper end permanently to the main strap assembly. The other, lower, end is detachably secured at selective, vertically spaced, locations along the main strap assembly. At the option of the user, the added strap assembly may be detachably secured to form a neck-encircling loop of selective shape and reach, to retain the main strap on the shoulder. This frees the gun side hand and arm for other uses. The lowermost one of the spaced attachment means is located to secure the auxiliary strap in out of the way storage position flatly against the main strap assembly when the neck loop is not needed. For safety and ease of release, snaps or other pull release fasteners are preferably utilized.

Therefore, the principal object of the invention is to provide a simple, non-entangling, safe sling permitting unattended firearm retention upon the shoulder, while not encumbering or restricting body motion or position, or restricting the use of arms and hands.

BRIEF DESCRIPTION OF THE DRAWINGS

In the drawings, which represent the best modes currently contemplated for carrying out the invention.

DETAILED DESCRIPTION OF ILLUSTRATED EMBODIMENTS

Figure 1:
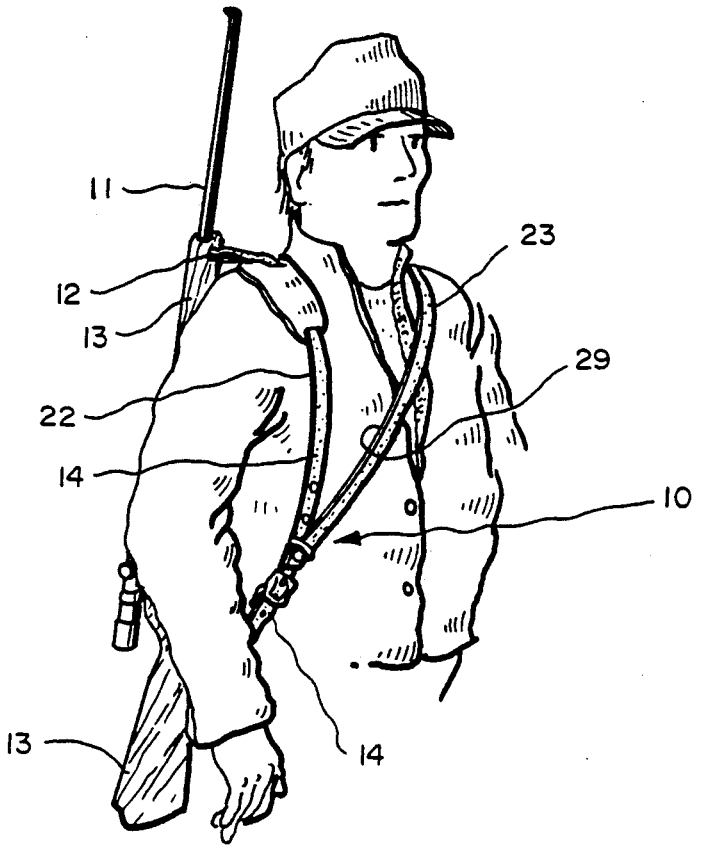
FIG. 1 is a view of a firearm sling in accordance with the invention in use in the firearm retaining mode, drawn to a reduced scale, FIG. 2 the firearm sling of FIG. 1, used however with the auxiliary neck-encircling strap thereof in storage mode against the primary sling loop, drawn to the scale of FIG. 1, FIG. 3 a perspective view of the sling assembly of FIGS. 1 and 2, drawn to a larger scale, FIG. 4 a side view of the sling of FIG. 3, drawn to substantially the same scale, FIG. 5 a front view of the sling of FIG. 4, taken along line 5—5 thereof, drawn to the same scale, and FIG. 6 a cross-sectional view of the primary sling strap of FIG. 3, taken along line 6—6 thereof, drawn to a larger scale.
Figure 2:
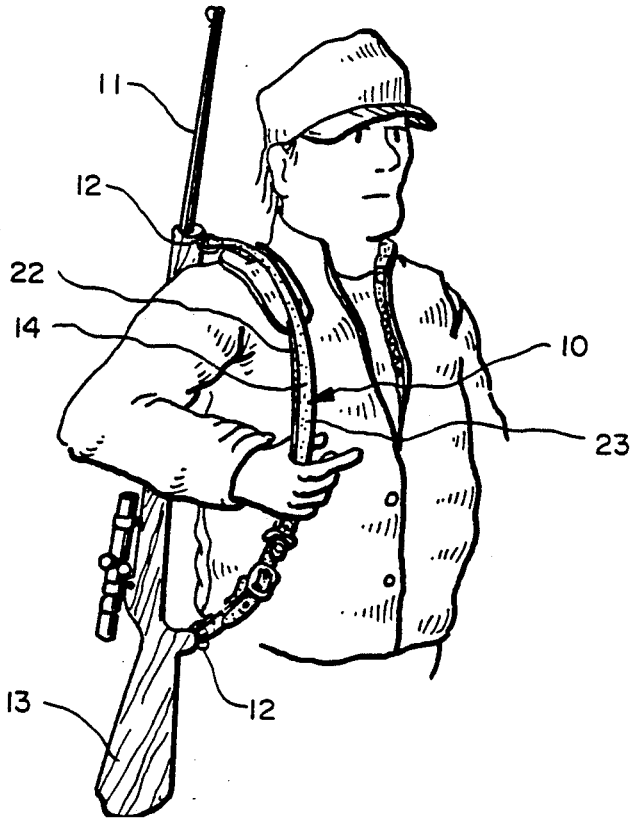
Figure 4:
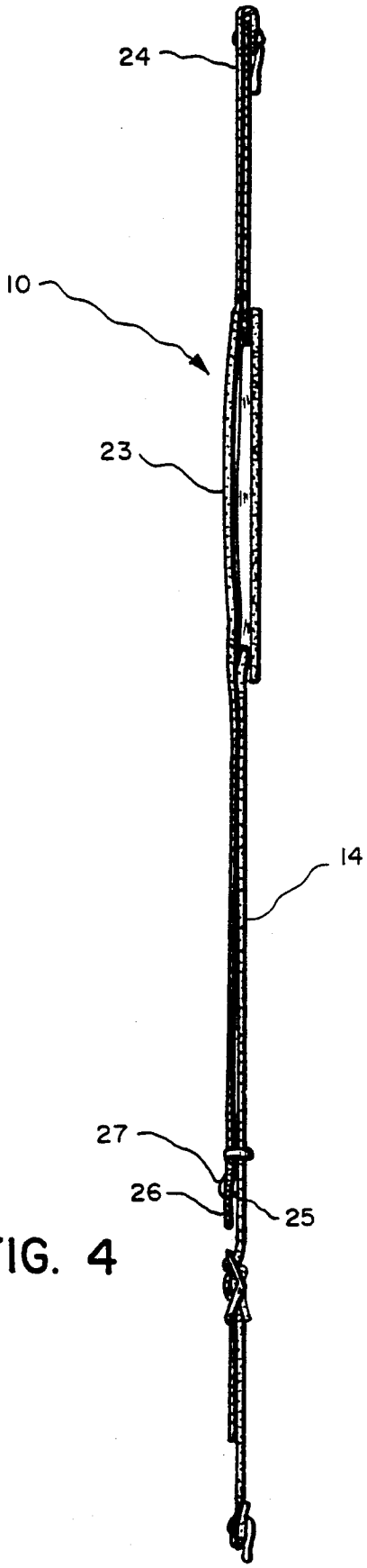
Figure 5:
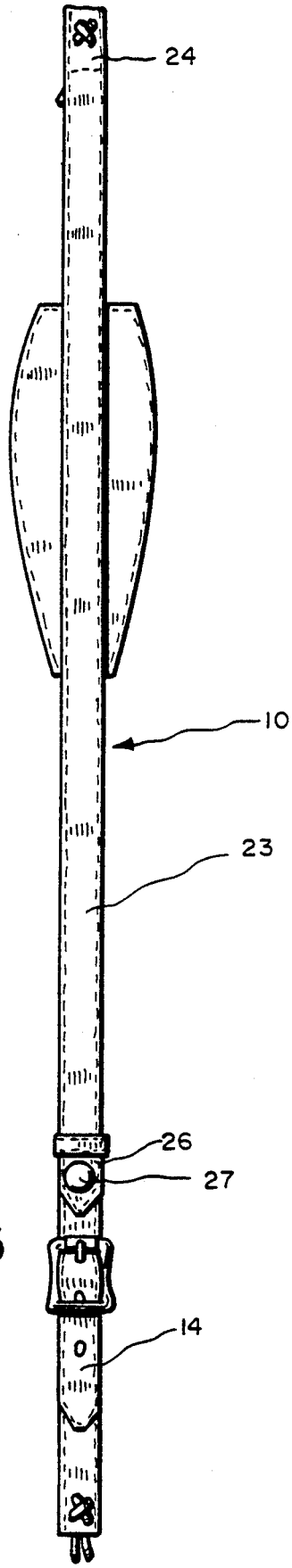

Alternate modes of use of firearm sling assembly 10 to suspend a rifle 11 from the shoulder of a hunter are illustrated in FIGS. 1 and 2. In one instance, the hunters hand is free, in the other it is necessarily employed to retain rifle 11 upon the shoulder.

Upper and lower hinge swivels 12 secure sling assembly 10 to rifle stock 13. A primary strap assembly 14 of non-elastic leather comprises two stitched together layers 15. (FIG. 6) Top and bottom strap loops 16 and 17 engage sling swivels 12, secured by loop lacing 18. Relatively long upper and a relatively short lower segments 19 and 20, respectively, are joined through a buckle assembly 21 carried by the lower segment, to permit adjustment of the length of shoulder engaging primary loop 22 as needed by the individual user.

Sling assembly 10 further comprises an auxiliary, sling retaining, strap assembly 23 also of non-elastic leather, having an upper end 24 secured as by stitching 25 flatly against the outside surface of primary strap assembly 14 extending therearound to form upper loop 16. Lower end 26 carries a snap female end 27, which may be selectively secured to one of a number of spaced apart male snap ends 28 on segment 19. This forms a neck encircling loop 29 of selected size. Strap loop 29 restrains primary loop 16 from slipping from the shoulder, regardless of positions, stooped or erect, assumed by the user. This frees the associated hand and arm for tasks other than retaining the firearm upon the shoulder. The firearm remains suspended loosely along the side of the body, substantially avoiding any restrictions upon body motion or position.

Sling assembly 10 is illustrated in FIG. 2 with retaining strap assembly 23 in storage position secured completely out of the way parallel to and flatly against upper main sling segment 19. In this storage position, the lowermost of the male snap ends 25, spaced to completely extend retaining strap 23, is engaged by snap female end 27.

Upper end 24 of retaining strap assembly 23 is secured permanently to primary sling 14. The snap assemblies secure lower end 26 releasably, allowing selection of neck loops 29 having various shapes and reaches. Also, easy, fast, release is provided when needed to avoid harmful entanglements in emergency situations. Other pull release type fasteners could be employed. Upper end 24 could also be fastened by snaps or other quickly releasable means, not illustrated. Both primary and auxiliary strap assemblies could be constructed of flexible non-elastic materials other than leather.

The invention may be embodied in other specific forms without departing from the spirit or essential characteristics thereof. The present embodiments are therefore to be considered as illustrative and not restrictive, the scope of the invention being indicated by the appended claims rather than by the foregoing description, and all changes that come within the meaning and range of equivalency of the claims are therefore intended to be embraced therein.

What is claimed and desired to be secured by United States Letters Patent is:

1. A sling assembly for retaining an elongate firearm suspended generally vertically from the shoulder of a user, said sling assembly comprising:

a primary, flexible, non-elastic, elongate strap assembly having upper and lower ends;

means securing said upper and lower ends vertically spaced apart to the firearm, so that the primary assembly forms a shoulder engaging loop therewith;

an auxiliary, non-elastic, elongate strap assembly having upper and lower ends;

means securing the upper end of the auxiliary strap assembly to the upper end of the primary strap assembly;

pull releasable means for securing the lower end of the auxiliary strap assembly to the primary assembly, spaced from the upper end securing means a distance equal to the length of the auxiliary strap assembly;

at least one other pull releasable means for securing the lower end of the auxiliary assembly tot he primary assembly at a distance from the auxiliary strap assembly upper end securing means less than the length of the auxiliary strap assembly, to cause the auxiliary assembly to form a neck-encircling loop with the primary assembly;

said pull releasable means being spaced from and operable separately from said at least one other pull releasable means;

engaging means for independently engaging one of the pull releasable means for securing the lower end of the auxiliary strap assembly to the primary strap assembly;

the pull releasable means and the at least one other pull releasable means being secured to the primary strap assembly and the engaging means being secured to the auxiliary strap assembly.

2. The sling assembly of claim 1, wherein:

the pull releasable means comprises a female or male snap assembly component;

the at least one other pull releasable means comprises a component identical to said snap assembly component;

and the engaging means comprises the other of a female or male snap assembly component.

3. The sling assembly of claim 2, wherein:

the primary strap assembly comprises an upper and a lower segment connected by fastening means permitting adjustment of the length of said assembly; and the pull releasable means and the at least one other pull releasable means are secured to said upper segment.

* * * * *